US007610765B2

(12) United States Patent
Kang et al.

(10) Patent No.: US 7,610,765 B2
(45) Date of Patent: Nov. 3, 2009

(54) REFRIGERANT CHARGE STATUS INDICATION METHOD AND DEVICE

(75) Inventors: Pengju Kang, Hartford, CT (US); Alan M. Finn, Hebron, CT (US); Sivakumar Gopalnarayanan, Simsbury, CT (US); Dong Luo, South Windsor, CT (US); Timothy P. Galante, West Hartford, CT (US)

(73) Assignee: Carrier Corporation, Farmington, CT (US)

( * ) Notice: Subject to any disclaimer, the term of this patent is extended or adjusted under 35 U.S.C. 154(b) by 677 days.

(21) Appl. No.: 11/025,836

(22) Filed: Dec. 27, 2004

(65) Prior Publication Data

US 2006/0137370 A1 Jun. 29, 2006

(51) Int. Cl.
*F25B 49/00* (2006.01)
*F25B 45/00* (2006.01)

(52) U.S. Cl. ..... 62/127; 62/129; 62/149

(58) Field of Classification Search ..... 62/125, 62/127, 129, 130, 145, 168, 183, 149; 165/11.1; 374/41, 116, 141; 702/41, 116, 141
See application file for complete search history.

(56) References Cited

U.S. PATENT DOCUMENTS 4,114,448 A * 9/1978 Merritt ..... 62/129
4,304,126 A 12/1981 Yelke
4,325,223 A 4/1982 Cantley
4,381,549 A * 4/1983 Stamp et al. ..... 62/126
4,429,578 A 2/1984 Darrel et al.
4,510,576 A 4/1985 MacArthur et al.
4,541,284 A 9/1985 Guagliumi et al.
4,561,261 A 12/1985 Kornrumpf et al.
4,624,112 A 11/1986 Proctor
4,745,519 A 5/1988 Breidegam
4,798,055 A * 1/1989 Murray et al. ..... 62/127
4,805,416 A 2/1989 Manz et al.
4,841,734 A * 6/1989 Torrence ..... 62/115

(Continued)

FOREIGN PATENT DOCUMENTS

EP 0 159 281 5/1990

(Continued)

OTHER PUBLICATIONS http://www.uview.com/homepage.html The UVIEW Tempscan A?C diagnostic device model #580000.*

(Continued)

*Primary Examiner*—Marc E Norman
(74) *Attorney, Agent, or Firm*—Marjama Muldoon Blasiak & Sullivan LLP

(57) ABSTRACT

A method and apparatus for determining the sufficiency of the refrigerant charge in an air conditioning system by use of temperature measurements. The temperature of the liquid refrigerant leaving the condenser coil and the outdoor temperature are sensed and representative electrical signals are generated. The electrical signals are converted to digital values that are than compared to predetermined optimal values to determine whether the system is properly charged with refrigerant. An appropriate LED is lighted to indicate that the system is undercharged, overcharged or properly charged. For non-TXV/EXV systems a third parameter i.e. the return air wet bulb temperature is also sensed and a representative digital value thereof is included in the comparison with the predetermined known values to determine if the charge is proper.

17 Claims, 3 Drawing Sheets

U.S. PATENT DOCUMENTS

| | | | | |
|---|---|---|---|---|
| 4,856,288 | A | | 8/1989 | Weber |
| 4,982,576 | A | | 1/1991 | Proctor et al. |
| 5,016,472 | A | | 5/1991 | Amrhein et al. |
| 5,046,322 | A | | 9/1991 | Bulla et al. |
| 5,057,965 | A | | 10/1991 | Wilson |
| 5,079,930 | A | | 1/1992 | Beaverson et al. |
| 5,156,012 | A | * | 10/1992 | Kuribara et al. ..... 62/129 |
| 5,186,012 | A | | 2/1993 | Czachorski et al. |
| 5,206,963 | A | * | 5/1993 | Wiens ..... 4/603 |
| 5,214,918 | A | | 6/1993 | Oguni et al. |
| 5,228,304 | A | * | 7/1993 | Ryan ..... 62/129 |
| H1226 | H | | 9/1993 | VanReene et al. |
| 5,241,833 | A | | 9/1993 | Ohkoshi |
| 5,248,168 | A | | 9/1993 | Chichester et al. |
| 5,251,453 | A | * | 10/1993 | Stanke et al. ..... 62/126 |
| 5,295,360 | A | | 3/1994 | Olds et al. |
| 5,317,903 | A | | 6/1994 | McClelland et al. |
| 5,341,649 | A | * | 8/1994 | Nevitt et al. ..... 62/126 |
| 5,354,103 | A | | 10/1994 | Torrence et al. |
| 5,362,530 | A | | 11/1994 | Kitami et al. |
| 5,374,084 | A | | 12/1994 | Potokar |
| 5,381,669 | A | * | 1/1995 | Bahel et al. ..... 62/129 |
| 5,406,980 | A | | 4/1995 | Allread et al. |
| 5,413,147 | A | | 5/1995 | Moreiras et al. |
| 5,423,189 | A | * | 6/1995 | Nicol et al. ..... 62/141 |
| 5,425,558 | A | | 6/1995 | Dennany, Jr. |
| 5,430,692 | A | | 7/1995 | Grupp et al. |
| 5,463,377 | A | | 10/1995 | Kronberg |
| 5,464,042 | A | | 11/1995 | Haunhorst |
| 5,468,028 | A | | 11/1995 | Olson |
| 5,474,336 | A | | 12/1995 | Hoff et al. |
| 5,540,463 | A | | 7/1996 | Potokar |
| 5,694,778 | A | | 12/1997 | Wilson |
| 5,752,726 | A | | 5/1998 | Fixemer |
| 5,807,332 | A | | 9/1998 | Augustine et al. |
| 5,834,943 | A | | 11/1998 | Miller |
| 5,868,437 | A | | 2/1999 | Teague |
| 5,961,157 | A | | 10/1999 | Baron et al. |
| 6,012,743 | A | | 1/2000 | Godeau et al. |
| 6,045,742 | A | | 4/2000 | McGrevy |
| 6,155,612 | A | | 12/2000 | Szabo |
| 6,161,394 | A | * | 12/2000 | Alsenz ..... 62/184 |
| 6,179,214 | B1 | | 1/2001 | Key et al. |
| 6,302,654 | B1 | | 10/2001 | Millet et al. |
| 6,308,523 | B1 | | 10/2001 | Scaringe |
| 6,324,854 | B1 | | 12/2001 | Jayanth |
| 6,330,802 | B1 | | 12/2001 | Cummings et al. |
| 6,354,332 | B1 | | 3/2002 | Burkhardt et al. |
| 8,382,678 | | | 5/2002 | Field of al. |
| 6,442,953 | B1 | | 9/2002 | Trigiani et al. |
| 6,460,354 | B2 | * | 10/2002 | Yabuki et al. ..... 62/129 |
| 6,470,695 | B2 | | 10/2002 | Gong |
| 6,481,756 | B1 | | 11/2002 | Field et al. |
| 6,497,435 | B1 | | 12/2002 | Luft et al. |
| 6,546,823 | B1 | | 4/2003 | Veit |
| 6,550,341 | B2 | | 4/2003 | van Schoor et al. |
| 6,553,774 | B1 | | 4/2003 | Ishio et al. |
| 6,571,566 | B1 | | 6/2003 | Temple et al. |
| 6,594,554 | B1 | | 7/2003 | Seem et al. |
| 6,658,373 | B2 | | 12/2003 | Rossi et al. |
| 6,758,051 | B2 | | 7/2004 | Jayanth et al. |
| 6,769,258 | B2 | | 8/2004 | Pierson |
| 6,868,678 | B2 | | 3/2005 | Mei et al. |
| 7,079,967 | B2 | | 7/2006 | Rossi et al. |
| 2002/0024218 | A1 | | 2/2002 | Manuli |
| 2002/0096209 | A1 | | 7/2002 | Danielson et al. |
| 2002/0121100 | A1 | * | 9/2002 | Yabuki et al. ..... 62/228.1 |
| 2002/0139128 | A1 | | 10/2002 | Suzuki et al. |
| 2002/0141877 | A1 | | 10/2002 | Jayanth et al. |
| 2002/0182005 | A1 | | 12/2002 | Milhas |
| 2003/0089119 | A1 | * | 5/2003 | Pham et al. ..... 62/131 |
| 2003/0158704 | A1 | * | 8/2003 | Triginai et al. ..... 702/182 |
| 2003/0172665 | A1 | | 9/2003 | Matsuoka et al. |
| 2003/0182950 | A1 | | 10/2003 | Mei et al. |
| 2003/0226367 | A1 | | 12/2003 | Palmer et al. |
| 2005/0235755 | A1 | | 10/2005 | Hindman |

FOREIGN PATENT DOCUMENTS

| | | |
|---|---|---|
| EP | 0 308 160 | 6/1991 |
| EP | 0 453 302 | 10/1991 |
| EP | 0 289 369 | 1/1992 |
| EP | 0 396 029 | 9/1992 |
| EP | 0 550 263 | 7/1993 |
| EP | 0 409 000 | 2/1994 |
| EP | 0 529 758 | 6/1996 |
| EP | 0 760 069 | 3/1997 |
| EP | 0 843 794 | 5/1998 |
| EP | 0 918 182 | 5/1999 |
| EP | 1 238 838 | 9/2002 |
| EP | 1 337 825 | 8/2003 |
| FR | 2667570 | 4/1992 |
| GB | 2 274 695 | 8/1994 |
| JP | 62-218748 | 9/1987 |
| JP | 62-261845 | 11/1987 |
| JP | 63-302238 | 12/1988 |
| JP | 2-110268 | 4/1990 |
| JP | 2-195165 | 8/1990 |
| JP | 4-55671 | 2/1992 |
| JP | 4-190062 | 7/1992 |
| JP | 4-273941 | 9/1992 |
| JP | 5-99475 | 4/1993 |
| JP | 5-231754 | 9/1993 |
| JP | 5-256543 | 10/1993 |
| JP | 7-55299 | 3/1995 |
| JP | 8-68576 | 3/1996 |
| JP | 8-261542 | 10/1996 |
| JP | 8-261543 | 10/1996 |
| JP | 2000-9048 | 1/2000 |
| JP | 2000-154954 | 6/2000 |
| JP | 2001-32884 | 2/2001 |
| JP | 2001-141279 | 5/2001 |
| WO | WO 93/20376 | 10/1993 |
| WO | WO 95/30106 | 11/1995 |
| WO | WO 95/30107 | 11/1995 |
| WO | WO 95/33157 | 12/1995 |
| WO | WO 96/17202 | 6/1996 |
| WO | WO 97/12167 | 4/1997 |
| WO | WO 97/13994 | 4/1997 |
| WO | WO 97/13995 | 4/1997 |
| WO | WO 97/47908 | 12/1997 |
| WO | WO 00/45053 | 8/2000 |
| WO | WO 01/23794 | 4/2001 |

OTHER PUBLICATIONS http://findarticles.com/p/articles/mi_qa3828/is_200209/ai_n9119405/pg_8 This reference to Tempscan device is dated in 2002.*

* cited by examiner

REFRIGERANT CHARGE STATUS INDICATION METHOD AND DEVICE

BACKGROUND OF THE INVENTION

This invention relates generally to air conditioning systems and, more particularly, to a method and apparatus for determining proper refrigerant charge in such systems.

Maintaining proper refrigerant charge level is essential to the safe and efficient operation of an air conditioning system. Improper charge level, either in deficit or in excess, can cause premature compressor failure. An over-charge in the system results in compressor flooding, which, in turn, may be damaging to the motor and mechanical components. Inadequate refrigerant charge can lead to increased power consumption, thus reducing system capacity and efficiency. Low charge also causes an increase in refrigerant temperature entering the compressor, which may cause thermal over-load of the compressor. Thermal over-load of the compressor can cause degradation of the motor winding insulation, thereby bringing about premature motor failure.

Charge adequacy has traditionally been checked using either the "superheat method" or "subcool method". For air conditioning systems which use a thermal expansion valve (TXV), or an electronic expansion valve (EXV), the superheat of the refrigerant entering the compressor is normally regulated at a fixed value, while the amount of subcooling of the refrigerant exiting the condenser varies. Consequently, the amount of subcooling is used as an indicator for charge level. Manufacturers often specify a range of subcool values for a properly charged air conditioner. For example, a subcool temperature range between 10 and 15° F. is generally regarded as acceptable in residential cooling equipment. For air conditioning systems that use fixed orifice expansion devices instead of TXVs (or EXVs), the performance of the air conditioner is much more sensitive to refrigerant charge level. Therefore, superheat is often used as an indicator for charge in these types of systems. A manual procedure specified by the manufacturer is used to help the installer to determine the actual charge based on either the superheat or subcooling measurement. Table 1 summarizes the measurements required for assessing the proper amount of refrigerant charge.

TABLE 1

Measurements Required for Charge Level Determination

| | Superheat method | Subcooling method |
|---|---|---|
| 1 | Compressor suction temperature | Liquid line temperature at the inlet to expansion device |
| 2 | Compressor suction pressure | Condenser outlet pressure |
| 3 | Outdoor condenser coil entering air temperature | |
| 4 | Indoor returning wet bulb temperature | |

To facilitate the superheat method, the manufacturer provides a table containing the superheat values corresponding to different combinations of indoor return air wet bulb temperatures and outdoor dry bulb temperatures for a properly charged system. This charging procedure is an empirical technique by which the installer determines the charge level by trial-and-error. The field technician has to look up in a table to see if the measured superheat falls in the correct ranges specified in the table. Often the procedure has to be repeated several times to ensure the superheat stays in a correct range specified in the table. Consequently this is a tedious test procedure, and difficult to apply to air conditioners of different makers, or even for equipment of the same maker where different duct and piping configurations are used. In addition, the calculation of superheat or subcool requires the measurement of compressor suction pressure, which requires intrusive penetration of pipes.

In the subcooling method, as with the superheat method, the manufacturer provides a table listing the liquid line temperature required as a function of the amount of subcooling and the liquid line pressure. Once again, the field technician has to look up in the table provided to see if the measured liquid line temperature falls within the correct ranges specified in the table. Thus, this charging procedure is also an empirical, time-consuming, and a trial-and-error process.

SUMMARY OF THE INVENTION

Briefly, in accordance with one aspect of the invention, a simple and inexpensive refrigerant charge inventory indication method and apparatus using temperature measurements only is provided for an air conditioning system.

In accordance with another aspect of the invention, the condensing liquid line and outdoor temperatures are sensed and representative electrical signals are generated. The signals are converted to digital form and sent to a CPU for comparison with stored values determined empirically in advance. On the basis of these comparisons, an appropriate LED is activated to indicate whether the system is properly or improperly charged with refrigerant.

By yet another aspect of the invention, in addition to the condensing liquid line temperature and outdoor temperature, the return air temperature is also sensed and a representative electrical signal generated and converted to a digital signal for comparison with the stored values by the CPU. This additional step is preferred for use in non-TXV/EXV systems.

By still another aspect of the invention, the sensed temperatures may be automatically converted to representative electrical signals, or as an alternative, the temperatures may be sensed by stand alone instruments, with the temperatures being dialed in by an operator to obtain representative electrical signals.

In the drawings as hereinafter described, preferred and alternative embodiments are depicted; however, various other modifications and alternate constructions can be made thereto without departing from the true spirit and scope of the invention.

DESCRIPTION OF THE PREFERRED EMBODIMENT

Figure 1:
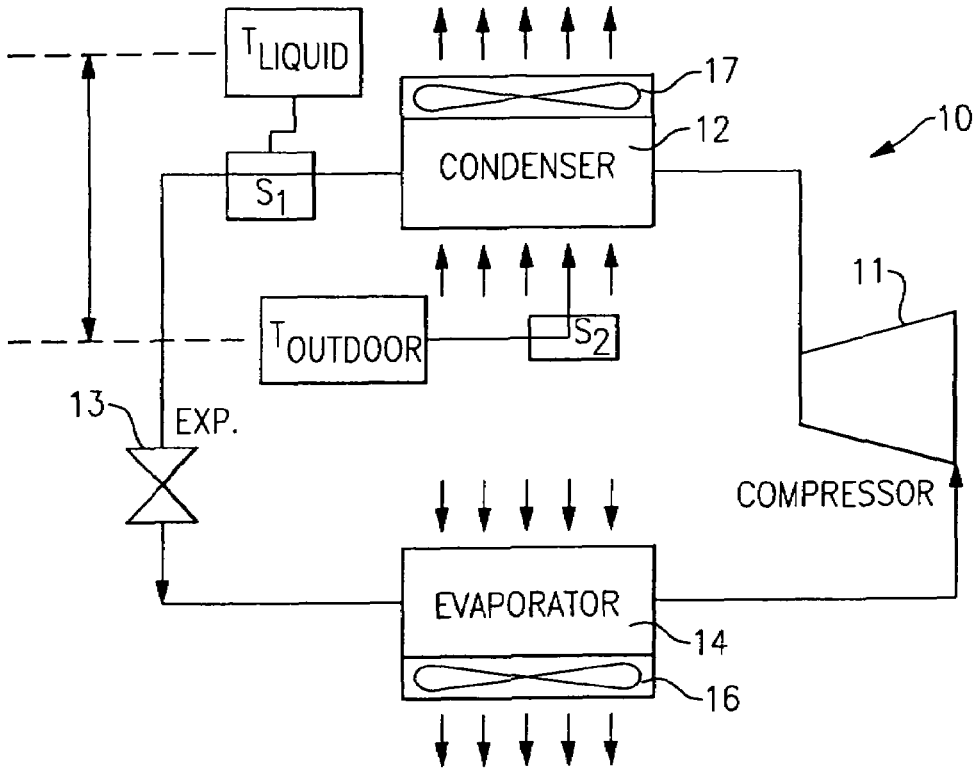
FIG. 1 is a schematic illustration of an air conditioning system with present invention incorporated therein.

Referring now to FIG. 1, the invention is shown generally at 10 as incorporated into an air conditioning system having a compressor 11, a condenser 12, an expansion device 13 and an evaporator 14. In this regard, it should be recognized that the present invention is equally applicable for use with heat pump systems.

In operation, the refrigerant flowing through the evaporator 14 absorbs the heat in the indoor air being passed over the evaporator coil by the evaporator fan 16, with the cooled air than being circulated back into the indoor air to be cooled. After evaporation, the refrigerant vapor is pressurized in the compressor 11 and the resulting high-pressure vapor is condensed into liquid refrigerant at the condenser 12, which rejects the heat in the refrigerant to the outdoor air being circulated over the condenser coil 12 by way of the condenser fan 17. The condensed refrigerant is than expanded by way of an expansion device 13, after which the saturated refrigerant liquid enters the evaporator 14 to continue the cooling process.

In a heat pump, during cooling mode, the process is identical to that as described hereinabove. In the heating mode, the cycle is reversed with the condenser and evaporator of the cooling mode acting as an evaporator and condenser, respectively.

It should be mentioned that the expansion device 13 may be a valve such as a TXV or an EXV which regulates the amount of liquid refrigerant entering the evaporator 14 in response to the superheat condition of the refrigerant entering the compressor 11. It may also be a fixed orifice, such as a capillary tube or the like.

In accordance with the present invention, there are only two measured variables needed for assessing the charge level in a TXV/EXV based air conditioning system. These measured variables are liquid line temperature $T_{liquid}$ and outdoor temperature $T_{outdoor}$ which are measured by sensors $S_1$ and $S_2$, respectively. These temperature sensors are thermocouples, thermistors, or the like, and the sensed temperatures are processed in a manner to be described hereinafter.

In a non-TXV/EXV system a third parameter is sensed i.e. the return air wet bulb temperature, which is indicative of the humidity. This temperature is processed along with the other two sensed temperatures as will be more fully described hereinafter.

Figure 2:
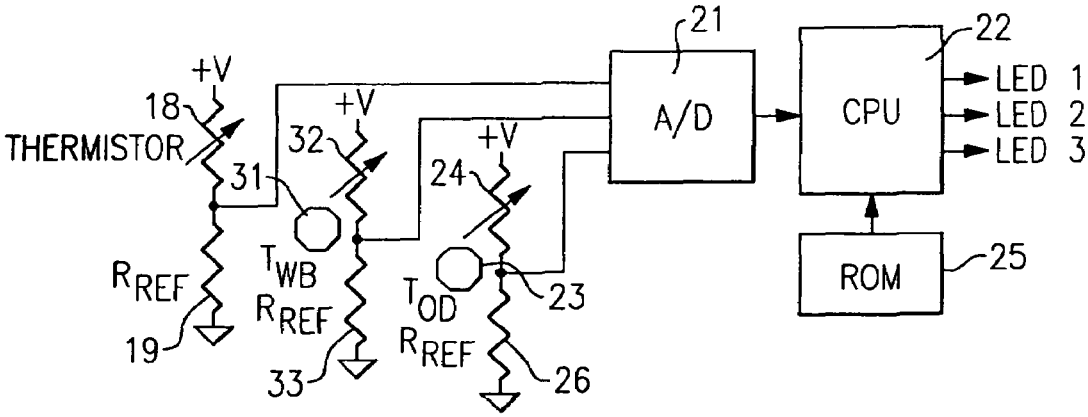
FIG. 2 is an electrical circuit diagram of one embodiment of the present invention.

Referring now to FIG. 2, there is shown circuitry that can be used to implement the present invention. A thermistor 18 is provided to sense the condenser liquid line temperature and convert the sensed temperature into a voltage signal. A reference resistor 19 with known resistance value is connected in series with a DC power supply and the thermistor 18. The voltage of the DC power supply and the value of the reference resistor 19 are determined on the basis of the range of temperatures of interest. The voltage signal representative of the sensed liquid line temperature $T_L$ is passed to A/D converter 21 with the resulting digital output then being passed to a CPU 22 for processing in a manner to be described hereinafter.

Figure 3:
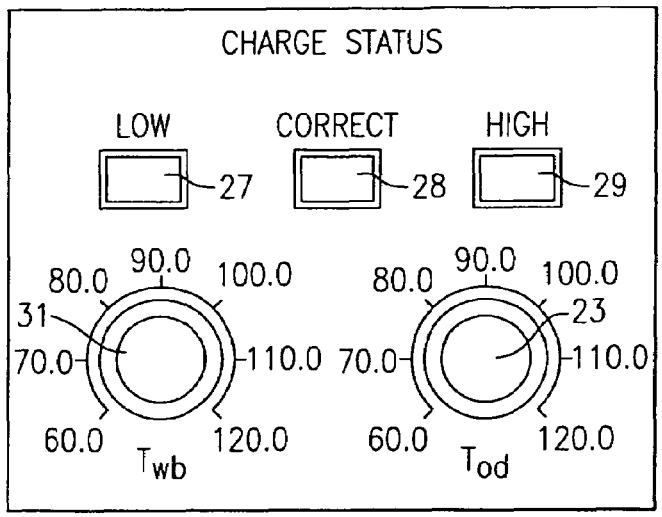
FIG. 3 is front view of the panel of a charge indicator in accordance with one embodiment of the present invention.

In addition to the voltage signal representative of the liquid line temperature, a voltage signal is also sent to the A/D converter 21 to represent the sensed outdoor temperature $T_{OD}$. In its simplest form, a technician or operator may measure the outdoor temperature using a commercially available thermometer and manually adjust the present device in order to send the representative voltage signal to the A/D converter 21. This is accomplished by manually adjusting the knob 23 (see FIG. 3) to the appropriate position. The knob 23 is attached to a variable resistor 24 that is appropriately calibrated such that when the DC voltage is applied across the variable resistor 24 and a fixed resistor 26, a change of knob position will produce a voltage level that represents the particular outdoor temperature sensed.

After the electrical signals representative of the sensed liquid line temperature $T_L$ and to the outdoor temperature $T_{OD}$ have been converted to digital values by the A/D converter 21 and sent to the CPU 22, the CPU compares the representative digital values with known stored values in a read only memory (ROM) 25 or other storage device to determine whether the system is adequately charged with refrigerant. As a result of the comparison the CPU 22 will send an electrical signal to the appropriate one of the three LEDs so as to light one of the three indicators 27, 28 or 29 indicating that the system is undercharged, properly charged or overcharged, respectively. The operator can then take whatever action is necessary in order to bring the system into a properly charged condition.

In non-TXV/EXV systems, a third parameter is required in order to obtain a meaningful determination as to the adequacy of the refrigerant charge in a system. This third parameter is the indoor or return air wet bulb temperature $T_{WB}$ that can be obtained by a technician or operator using a commercially available humidity sensor. This value is inputted into the device by way of the knob 31 which is selectively moved to a position so as to set the variable resistor 32 such that, when the DC voltage is applied, across the variable resistor 32 and a fixed resistor 33 it causes, a specific voltage will be produced to represent the return air wet bulb temperature $T_{WB}$ that has been sensed. Again, the resulting electrical signal is sent to the A/D converter 21 and a representative digital value is sent to the CPU 22 for processing. Again, the resulting value is applied by the CPU 22 to send an appropriate signal to one of the three LEDs so as to light the appropriate indicator 27, 28 or 29.

The device as described hereinabove, which relies on an operator using standalone sensors and then manually inputting the resulting temperatures into the device, is a simple low cost approach to obtain an indication of refrigerant charge adequacy in a system. However, an alternative is for the temperature and/or humidity sensors to be built-in as an integral part of the system such that electrical signals representative of those temperatures can automatically be sent directly to the A/D converter 21 and processed as described hereinabove. In such case, the knobs 23 and 31 and their associated circuitry would not be required. This latter approach would be difficult to implement in older systems existing in the field since the cost would probably not be commercially feasible.

In the implementation of the present invention in diagnosing charge adequacy in an air conditioning system, a parameter defined as the approach temperature (APT) is used. In a cooling system, the condenser APT is defined as the difference in temperature between the inlet air temperature (i.e. the outdoor air temperature $T_{OD}$) and the refrigerant temperature exiting the condenser ($T_L$), or $APT=T_L-T_{OD}$.

Figure 4:
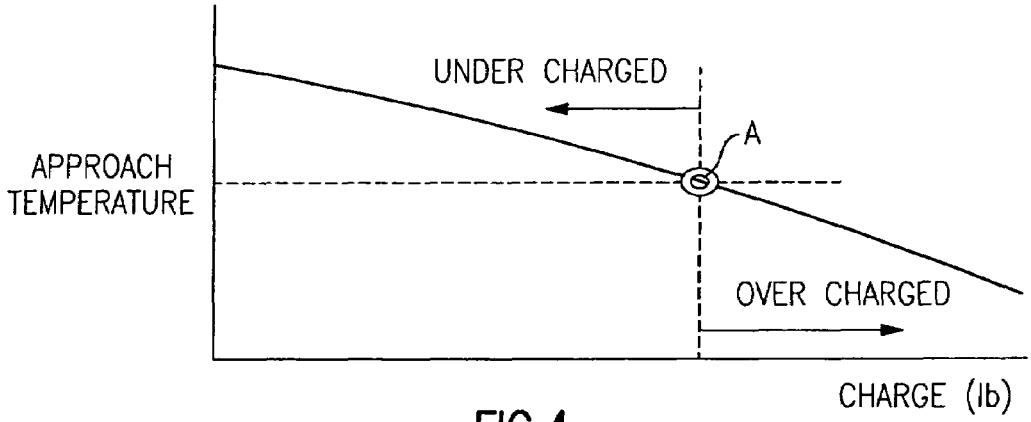
FIG. 4 is a graphic illustration of the relationship between charge in a system and the approach temperature (subsequently defined) thereof.

The APT is affected by a number of variables including indoor air condition (i.e. dry bulb air temperature and relative humidity) and outdoor temperature. FIG. 4 illustrates how APT changes as a function of charge at a given indoor and outdoor temperature. An overcharged cooling system will have lower APT than expected, while undercharged systems will have a higher APT value.

If a system is significantly undercharged its operation becomes unstable and the present method and apparatus is not likely to be successfully used. However, when a typical cooling system is newly installed, the unit would normally be charged to a point at or near the optimal point A as shown in FIG. 4. This point is normally the charge amount specified by the manufacturer of a standard configuration. With this kind of charge condition and for conditions where the system is moderately undercharged or overcharged, a system would normally be running in a steady state condition and the present invention is applicable thereto.

Figure 5:
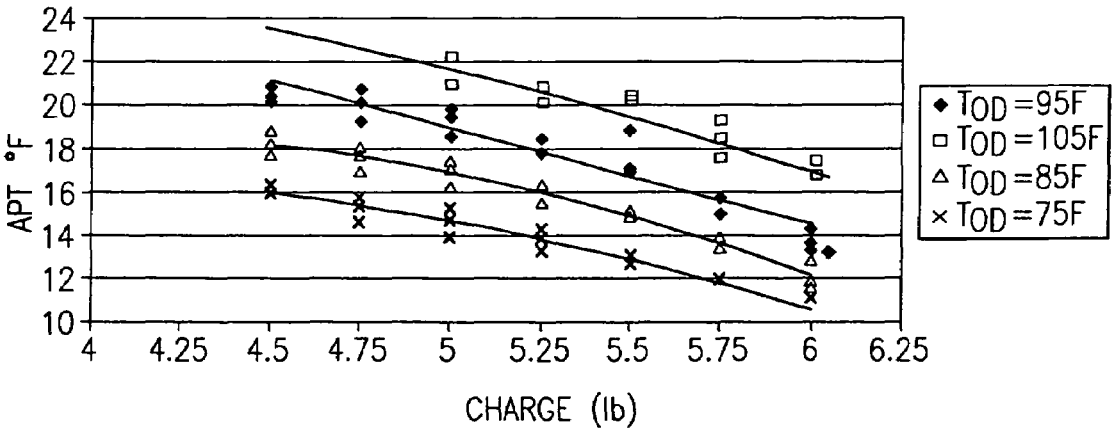
FIG. 5 is a graphic illustration or charge map indicating how the approach temperature varies in response to refrigerant charge, and varying indoor and outdoor conditions.

If a map or table is available that characterizes optimal APTs for various indoor/outdoor conditions, then such a map can be used to charge a system to its optimal point. Such a map is shown in FIG. 5 wherein, as an example, a 36,000 BTU per hour residential cooling system was test run with varying charges, indoor relative humidity and outdoor conditions. For this simulation, it was assumed that data was required for charge diagnostics of a non-TXV/EXV system such that the use of the APT as a charge indicator requires the measurements of outdoor temperature and either indoor wet bulb temperature or both indoor dry bulb and relative humidity. In the present case, measurements were taken at an indoor temperature at 80° F. and at relative humidity values of 0.3, 0.5, and 0.7.

It was recognized that at low outdoor temperature, the relationship between charge and APT is well defined under different outdoor conditions. When indoor temperatures ($T_{id}$) are fixed the indoor relative humidity (RH) affects the APT at all charge conditions. In the real environment, indoor temperatures can, of course, vary significantly. Since the combination of dry bulb temperature and relative humidity is reflected in the wet bulb measurements, the indoor wet bulb temperature, as well as the outdoor temperature is essential in evaluating the charge in a non-TXV/EXV system.

The data shown in FIG. 5 indicates how the APT varies in response to charges in refrigerant charge, indoor conditions and outdoor conditions. This set of data, which is known as a charge map, can be obtained in the test chamber by conducting a series of test on the unit. After the map is generated, it can than be programmed into the ROM 25 of the diagnostic device. For this purpose, it will be recognized that the map can be either programmed as a table in the charge indicator or as a function. Once the map is established in the device, it can be used for charge diagnostics in the field.

While the present description relates to a charge map for a particular manufacturers make and model of an air conditioning unit, the charge map for other manufacturers units of many makes and models can be stored in the ROM 25 with additional user input, preferably by menu selection, to choose the appropriate charge map.

Figure 6:
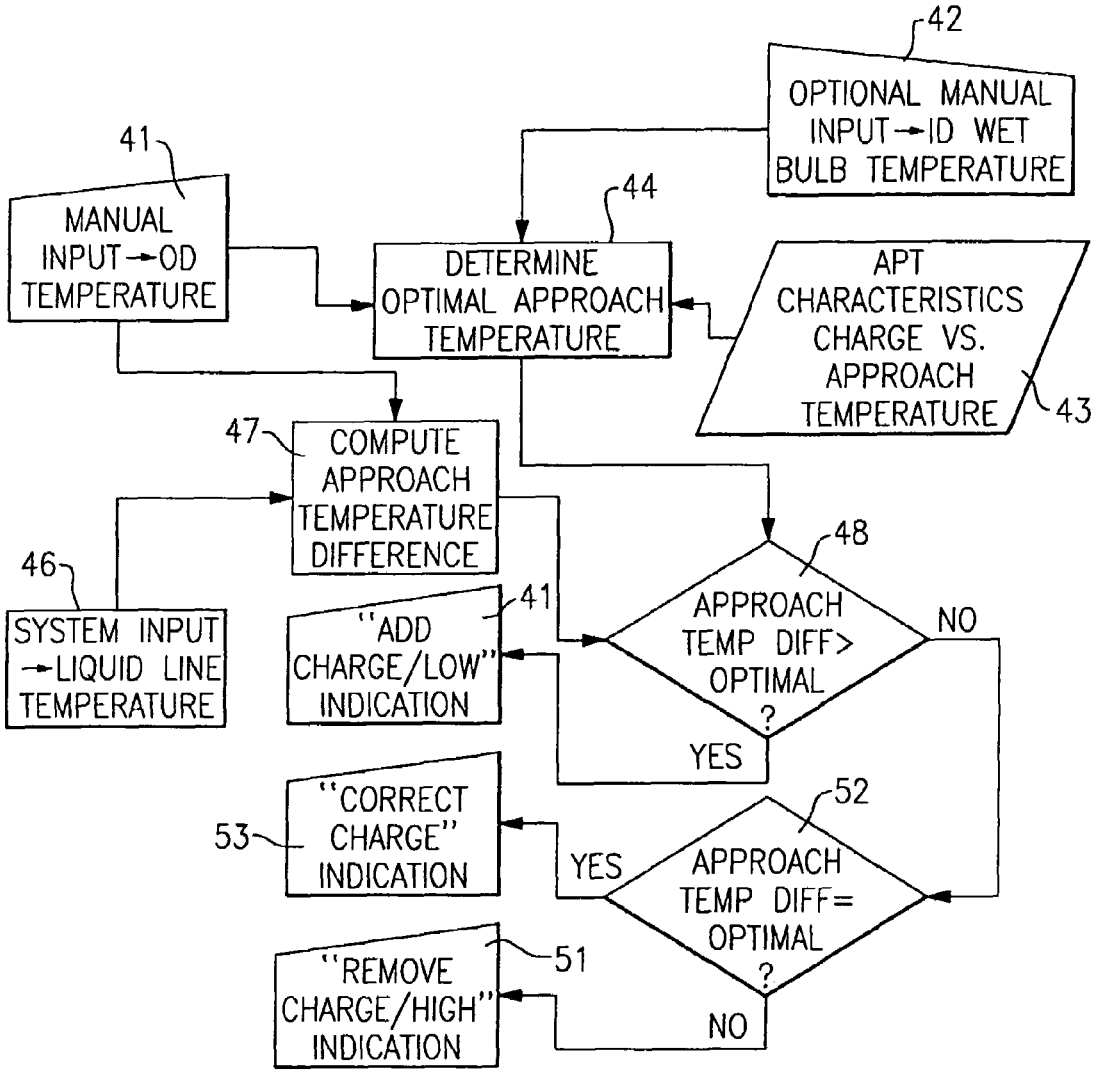
FIG. 6 is a flow chart indicating the steps involved in the diagnostic algorithm of the present invention.

In addition to the charge map, the ROM 25 also has a diagnostic algorithm stored therein for purposes of automatically stepping through the process of charge diagnostics. The diagnostic algorithm is shown in FIG. 6 hereof.

At block 41, the outdoor temperature $T_{OD}$ is sensed by an operator and manually set into the apparatus by turning the appropriate knob 23 of the diagnostic apparatus. If the system is a non-TXV/EXV system, the operator is also required to sense the indoor wet bulb temperature $T_{wb}$ and input that data into the device by way of the knob 31 as shown in block 42. Of course, the charge map for the particular unit has already been stored in the ROM as shown at block 43. With inputs from blocks 41, 42, and 43, the optimal APT for the unit is determined at block 44.

In the meantime, as shown at block 46, the liquid line temperature $T_L$ has been automatically measured by the device and the APT is calculated at block 47 by subtracting the outdoor temperature $T_{OD}$ from the liquid line temperature $T_L$.

The next step, which occurs at block 48, compares the computed APT from block 47 with the optimal APT as determined in block 44. If the actual APT exceeds the optimal APT by over a specified range, e.g. 2°, than the unit under test is deemed undercharged and an indication will be given that refrigerant charge needs to be added as shown in block 49. If, on the other hand, the actual APT is less than the optimal APT by a predetermined range, e.g. 2°, than the unit will be diagnosed as overcharged and an indication will be given that refrigerant charge needs to be removed from the system as shown in block 51. The process than continues until the measured APT is close to the optimal APT as indicated in block 52, in which case an indication is then provided that a correct charge condition has been reached as shown at block 53.

For each of the blocks 49, 51 and 53, the indication that is given to the operator is the lighting of the appropriate LED as described hereinabove. From those indications, the operator than proceeds appropriately until the proper charge is obtained.

While the present invention has been particularly shown and described with reference to a preferred embodiment as illustrated in the drawings, it will be understood by one skilled in the art that various changes in detail may be effected therein without departing from the true spirit and scope of the invention as defined by the claims. In particular, the present invention includes the equivalence of software and hardware in digital computing and the equivalence of digital and analog hardware in producing a particular signal indicative of charge

We claim:

1. A method of determining the sufficiency of refrigerant charge in an air conditioning system having a compressor, a condenser coil, an expansion device and an evaporator coil connected in serial refrigerant flow relationship, comprising the steps of:

sensing the temperature of the refrigerant leaving the condenser coil and generating a first electrical signal representative thereof;

sensing the outdoor temperature and generating a second electrical signal representative thereof;

converting said first and second electrical signals to first and second digital values; and comparing said first and second digital values to obtain an approach temperature difference; and comparing said approach temperature difference with predetermined optimal values to determine whether a proper refrigerant charge condition exists.

2. A method as set forth in claim 1 wherein said outdoor temperature is sensed by a standalone temperature sensor and said second electrical signal is generated by a variable device which is selectively adjustable as a function of the sensed outdoor temperature.

3. A method as set forth in claim 1 wherein said step of comparing said first and second digital values is accomplished by way of a computer.

4. A method as set forth in claim 1 wherein said predetermined optimal values are empirically determined for a particular air conditioning system.

5. A method as set forth in claim 1 wherein said predetermined optimal values are stored in a ROM.

6. A method as set forth in claim 1 and including the further steps of:

sensing an indoor air wet bulb temperature and generating a third electrical signal representative thereof; and converting said third electrical signal to a third digital value and including said third digital value with said approach temperature difference to be compared with said predetermined optimal values.

7. A method as set forth in claim 6 wherein said indoor air wet bulb temperature is sensed by a standalone sensor and said third electrical signal is generated by way of selective adjustment of a variable device.

8. A method as set forth in claim 1 and including the further step of providing a visual indication of said refrigerant charge condition.

9. A method as set forth in claim 8 wherein said visual indication is by way of selectively lighting one of a plurality of LEDs.

10. Apparatus for determining the sufficiency of refrigerant charge in an air conditioning system having a compressor, condenser coil, an expansion device and an evaporator coil interconnected in serial refrigerant flow relationship comprising:

a temperature sensor for sensing the temperature of the liquid refrigerant leaving the condenser;

a first signal generator for generating an electrical signal representative of said sensed liquid refrigerant temperature;

a second signal generator for generating a second electrical signal representative of a sensed outdoor temperature;

an analog-to-digital converter for converting said first and second electrical signals to first and second digital values, respectively;

a first comparator for comparing said first and second digital values to obtain an approach temperature difference; and a second comparator for comparing said approach temperature difference with predetermined optimal values to determine whether a proper refrigerant charge condition exists.

11. Apparatus as set forth in claim 10 wherein said second signal generator comprises a variable resistance device which is selectively adjusted to generate an electrical signal that is representative of a sensed outdoor temperature.

12. Apparatus as set forth in claim 10 wherein said comparing means is a computer.

13. Apparatus as set forth in claim 10 wherein said predetermined optimal values are empirically determined for a particular air conditioning system.

14. Apparatus as set forth in claim 10 wherein said predetermined optimal values are stored in a ROM.

15. Apparatus as set forth in claim 10 and including a third signal generator for generating a third electrical signal representative of indoor wet bulb temperature.

16. Apparatus as set forth in claim 15 wherein said third electrical signal is converted to a third digital value by said analog-to-digital converter.

17. Apparatus as set forth in claim 16 wherein said comparing means includes said third digital value with said first and second digital values to be compared with said optimal values.

* * * * *